US008350793B2

(12) United States Patent
Hung

(10) Patent No.: US 8,350,793 B2
(45) Date of Patent: Jan. 8, 2013

(54) IMAGE OVER-DRIVING DEVICES AND IMAGE OVER-DRIVING CONTROLLING METHODS

(75) Inventor: Ming-Chi Hung, Hsinchu (TW)

(73) Assignee: AU Optronics Corp., Hsinchu (TW)

( * ) Notice: Subject to any disclaimer, the term of this patent is extended or adjusted under 35 U.S.C. 154(b) by 1033 days.

(21) Appl. No.: 12/260,131

(22) Filed: Oct. 29, 2008

(65) Prior Publication Data

US 2009/0213050 A1 Aug. 27, 2009

(30) Foreign Application Priority Data

Feb. 27, 2008 (TW) ..... 97106825 A

(51) Int. Cl.
*G09G 3/36* (2006.01)
*G09G 5/00* (2006.01)

(52) U.S. Cl. ..... 345/89; 345/204; 345/690

(58) Field of Classification Search ..... 345/87–102
See application file for complete search history.

(56) References Cited

U.S. PATENT DOCUMENTS 7,023,414 B2 4/2006 Ham
7,109,949 B2 9/2006 Sekiya et al.
7,454,677 B2 * 11/2008 Whetsel ..... 714/726
7,649,575 B2 * 1/2010 Mamba et al. ..... 348/790
7,724,971 B2 * 5/2010 Huang et al. ..... 382/236
7,804,474 B2 * 9/2010 Chen et al. ..... 345/98
7,986,314 B2 * 7/2011 Tsai et al. ..... 345/204
8,072,237 B1 * 12/2011 Rahim et al. ..... 326/39
8,154,491 B2 * 4/2012 Ho et al. ..... 345/87
2003/0169247 A1 * 9/2003 Kawabe et al. ..... 345/204
2004/0012551 A1 * 1/2004 Ishii ..... 345/87
2005/0062681 A1 3/2005 Honbo
2005/0162566 A1 * 7/2005 Chuang et al. ..... 348/714
2005/0237316 A1 * 10/2005 Huang et al. ..... 345/204
2006/0072042 A1 * 4/2006 Chang et al. ..... 348/714
2006/0072664 A1 * 4/2006 Kwon et al. ..... 375/240.16
2006/0132470 A1 * 6/2006 Ho et al. ..... 345/204
2007/0018934 A1 1/2007 Kim et al.
2007/0019003 A1 * 1/2007 Imai et al. ..... 345/629
2007/0296656 A1 * 12/2007 Lin ..... 345/87
2008/0002912 A1 * 1/2008 Chen et al. ..... 382/298
2008/0018571 A1 * 1/2008 Feng ..... 345/87
(Continued)

OTHER PUBLICATIONS

Taiwanese language office action dated Sep. 26, 2012.

*Primary Examiner* — Amare Mengistu
*Assistant Examiner* — Sarvesh J Nadkarni
(74) *Attorney, Agent, or Firm* — McClure, Qualey & Rodack, LLP

(57) ABSTRACT

An image over-driving device is provided. An image detection device detects a size and a moving speed of an object according to an image signal and outputs an over-driving control signal according to the detected size and moving speed. A first image register receives and temporarily stores first image data of the image signal in a first frame period, and receives second image data of the image signal and outputs the first image data as a buffer data in a sequential second frame period. A first over-driving unit includes first and second lookup tables recording different over-driving parameters. The first over-driving unit generates first and second over-driving signals according to the buffer data and the second image data respectively by using the first and second lookup tables. The first multiplexer selects the first or second over-driving signal according to the over-driving control signal to drive a display device.

16 Claims, 6 Drawing Sheets

U.S. PATENT DOCUMENTS

2008/0024473 A1* 1/2008 Hsu et al. ..... 345/204
2008/0174591 A1* 7/2008 Park et al. ..... 345/212
2008/0231618 A1* 9/2008 Chen et al. ..... 345/204
2009/0002292 A1* 1/2009 Koo et al. ..... 345/87
2009/0073159 A1* 3/2009 Ho et al. ..... 345/213
2010/0164982 A1* 7/2010 Lu ..... 345/604

* cited by examiner

IMAGE OVER-DRIVING DEVICES AND IMAGE OVER-DRIVING CONTROLLING METHODS

CROSS REFERENCE TO RELATED APPLICATIONS

This application claims the benefit of Taiwan application Serial No. 97106825 filed Feb. 27, 2008, the subject matter of which is incorporated herein by reference.

BACKGROUND OF THE INVENTION

1. Field of the Invention

The invention relates to an image over-driving device and an image over-driving controlling method for a liquid crystal display (LCD), and more particularly to an image over-driving device and an image over-driving controlling method for avoiding overshot effect for an LCD.

2. Description of the Related Art

An LCD comprises an array of pixels. In each pixel, a liquid crystal is controlled by a cross voltage thereof to change a transmittance ratio, and a desired gray level is represented according to the transmittance ratio of the liquid crystal.

FIG. 1 is a schematic diagram of a conventional LCD panel and peripheral driving devices thereof. As shown in FIG. 1, a display array 1 is formed by interlacing data electrodes D1 to Dm and gate electrodes G1 to Gn. The interlaced data electrode and gate electrode are arranged to control one display unit. For example, the interlaced data electrode D1 and gate electrode G1 control a display unit 14. Referring to FIG. 1, each display unit comprises a thin film transistor (TFT) (Q11-Q1*m*, Q21-Q2*m* . . . Qn1-Qnm) for controlling the data input and a storage capacitor (C11-C1*m*, C21-C2*m* . . . Cn1-Cnm). A gate and a drain of the TFT are respectively coupled to a gate electrode (G1-Gn) and a data electrode (D1-Dm). Through a scan signal on the gate electrode (G1-Gn), the TFTs on the same row (that is on the same gate electrode) can be turned on/off, thereby controlling whether video signals on the data electrodes (D-Dm) are written into the corresponding pixel units.

As for peripheral driving devices also shown in FIG. 1, a gate driver 10 provides scan signals to the gate electrode G1-Gn according to a predetermined scan order. When one gate electrode carries the scan signal, the TFTs within the pixel units on the row or on the gate electrode are turned on. When one gate electrode is selected, a data driver 12 provides video signals to the pixel units on the gate electrode through the data electrodes D1-Dm according to image data that is prepared, but not yet displayed. A single frame is displayed each time the scan driver 10 finishes scanning all of the n rows. Therefore, the object of displaying images is achieved by repeatedly scanning scan lines and outputting video signals.

A timing controller 16 receives RGB color signals and timing signals for the display controlling, such as a vertical synchronization signal, a horizontal synchronization signal, a clock signal, and a data enable signal, from an external graphic controller or graphic card. According to the timing signals, the timing controller 16 outputs a gate-electrode control signal to the gate driver 10 and outputs the RGB color signals and data control signals to the data driver 10 for the display controlling.

In order to accelerate polarity change of liquid crystal molecules (referred to liquid crystal display units hereinafter) and the speed in which the liquid crystal display units reach the target gray level, a conventional timing controller is required to adjust voltage provided to the liquid crystal display units by using an over-driving method. An 8-bit panel which can display 256 ($2^8$) gray levels is given as an example in the following, wherein the lower gray level represents a darker image, while the higher gray level represents a lighter image. When an image displayed by a liquid crystal display unit is changed from the 0 gray level to the 230 gray level, a conventional timing controller provides greater cross voltage (for example, a voltage corresponding to the 250 gray level) to the liquid crystal display unit, thereby achieving the object of accelerating the gray-level change.

Since response of a liquid crystal display unit of an AV-type LCD is longer when it displays images with low gray-levels, efficacy of the over-driving procedure has to be enhanced. However, for the conventional over-driving method, image quality is degraded due to the overshot effect when size of the displayed object is too small or speed thereof is too fast.

FIG. 2A shows movement of a displayed object by frames, and a displayed object with a low gray-level is given as an example. As shown in FIG. 2A, a displayed object 20 moves along the direction of the arrow 22. FIG. 2A shows the positions of the displayed object 20 in the (N−1)th frame, the Nth frame, and the (N+1)th frame. FIG. 2B shows gray-level change of the liquid crystal display unit displaying the object 20. The target gray level of the liquid crystal display unit is a high gray level (for example 230 gray level) in the (N−1)th frame, a low gray level (for example 5 gray level in the Nth frame, and a high gray level (for example 230 gray level) in the (N+1)th frame. In FIG. 2B, a solid line represents the target gray level, and the dotted line represents the actual gray level of the liquid crystal display unit.

As shown in FIG. 2B, due to the limitation from the response time of the liquid crystal display unit, the actual gray level of the liquid crystal display unit in the Nth frame is not decreased to the low target gray level. In the (N+1)th frame, an over-driving cross voltage is provided to the liquid crystal display unit according to the difference between the target gray levels of the Nth frame and the (N+1)th frame by the conventional over-driving method. Since the actual gray level of the Nth frame is higher than the target gray level thereof, when an over-driving cross voltage is provided to the liquid crystal display unit according to the difference between the target gray levels of the Nth frame and the (N+1)th frame by the conventional over-driving method, the actual gray level in the initial period of the (N+1) the frame is significantly over the target gray level of the (N+1)th frame, resulting in overshot effect.

BRIEF SUMMARY OF THE INVENTION

An exemplary embodiment of an image over-driving device for a display device is provided. The display device comprises a plurality of pixel units and displays a displayed object according to an image signal in a plurality of sequential frame periods. The image over-driving device comprises an image detection device, a first image register, a first over-driving unit, and a first multiplexer. The image detection device detects a size of the displayed object and a moving speed of the displayed object in the sequential frame periods according to the image signal and outputs an over-driving control signal according to the size of the displayed object and the moving speed of the displayed object in the sequential frame periods. The first image register receives and temporarily stores first image data of the image signal in a first frame period. The first image register receives second image data of the image signal and outputs the first image data as a buffer data in a second frame period sequential to the first frame period. The first over-driving unit comprises a first lookup table and a second lookup table in which the different over-driving parameters are recorded. The first over-driving unit generates a first over-driving signal according to the buffer data, the second image data, and the first lookup table, and generates a second over-driving signal according to the buffer data, the second image data, and the second lookup table. The first multiplexer selects the first over-driving signal or the second over-driving signal according to the over-driving control signal to drive the display device.

An exemplary embodiment of an image over-driving controlling method for a display device is provided. The display device comprises a plurality of pixel units and displays a displayed object according to an image signal in a plurality of sequential frame periods. The method comprises: detecting a size of the displayed object and a moving speed of the displayed object in the sequential frame periods according to the image signal; generating an over-driving control signal according to the size of the displayed object and the moving speed of the displayed object in the sequential frame periods; in a first frame period, receiving and temporarily storing first image data of the image signal; in a second frame period sequential to the first frame period, receiving second image data of the image signal and outputting the first image data as a buffer data; and generating a first over-driving signal according to the buffer data, the second image data, and the over-driving control signal and driving the display device according to the first over-driving signal.

Another exemplary embodiment of an image over-driving controlling method for a display device is provided. The display device comprises a plurality of pixel units and displays a displayed object according to an image signal in a plurality of sequential frame periods. The method comprises: generating a second over-driving signal according to the buffer data, the second image data, and the over-driving control signal; temporarily storing the second over-driving signal and, in a third frame period sequential to the second frame period, outputting the second over-driving signal as the buffer data; receiving a third image data of the image signal in the third frame period; and generating a third over-driving signal according to the buffer data, the third image data, and the over-driving control signal and driving the display device according to the third over-driving signal.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
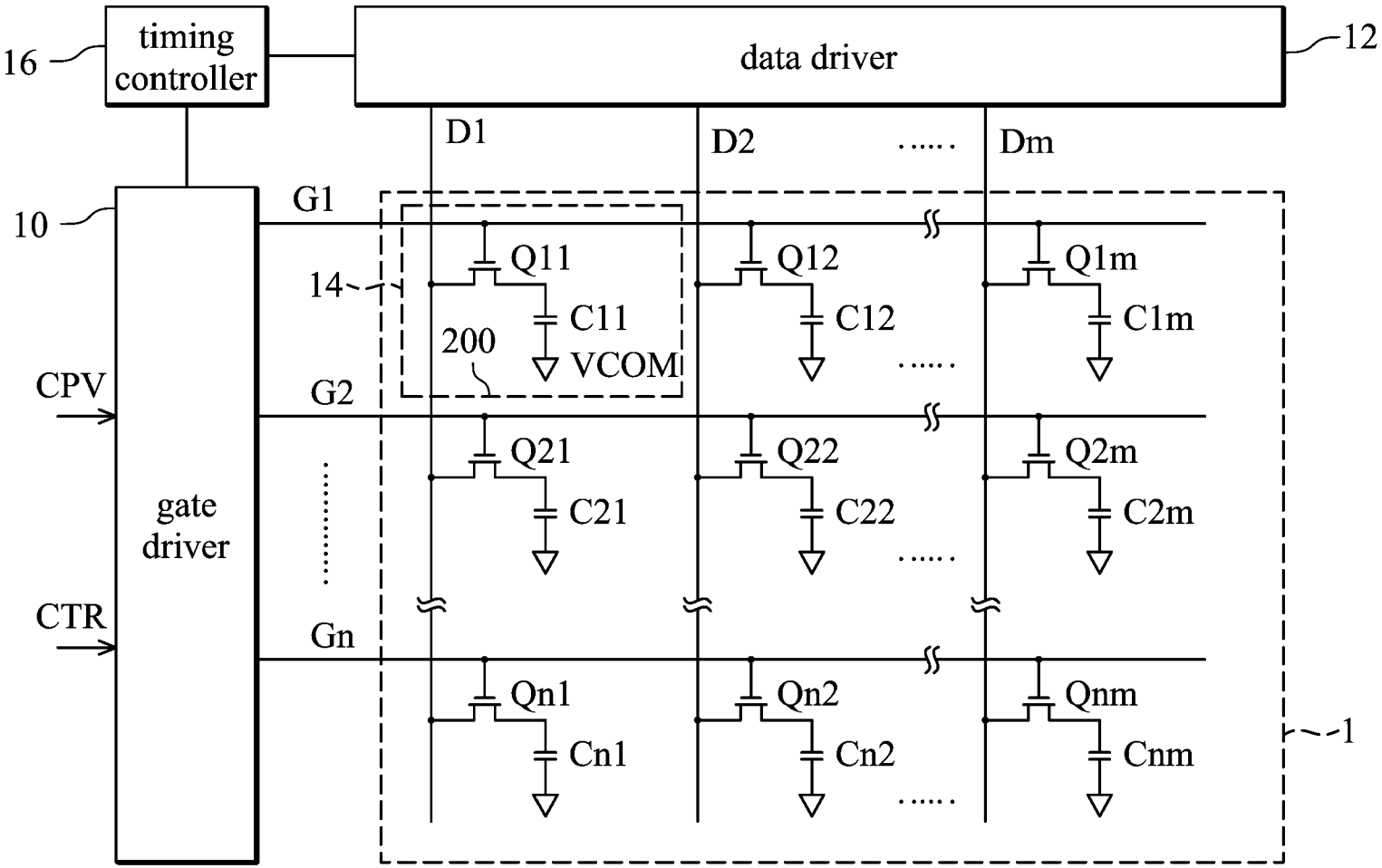
FIG. 1 (PRIOR ART)
FIG. 1 is a schematic diagram of a conventional LCD panel and peripheral driving devices thereof.
Figure 2B:
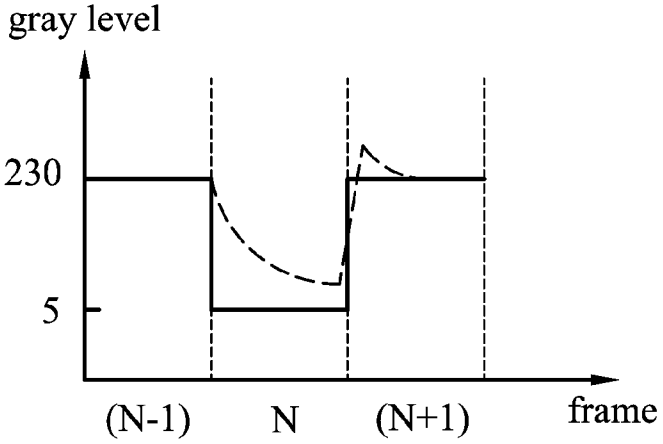
FIG. 2B (PRIOR ART)
FIG. 2B shows gray-level change of the liquid crystal display unit displaying an object.
Figure 2A:
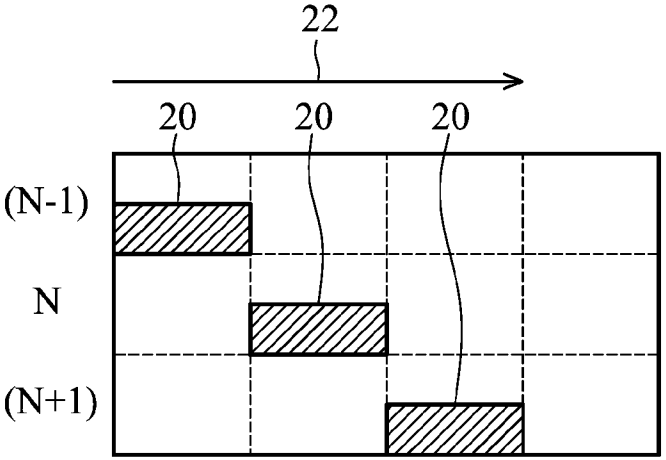
FIG. 2A (PRIOR ART)
FIG. 2A shows movement of a displayed object by frames.

The following description is of the best-contemplated mode of carrying out the invention. This description is made for the purpose of illustrating the general principles of the invention and should not be taken in a limiting sense. The scope of the invention is best determined by reference to the appended claims.

Image over-driving devices are provided. In an exemplary embodiment of an image over-driving device in FIG. 3, an image over-driving device 30 can be disposed in a timing controller and applied for a display device 39 which comprises a plurality of pixel units. The display device 39 displays a displayed object according to an image signal S in a plurality of sequential frame periods. The image signal S comprises image information of the display device 39 in sequential frames. In the embodiment, a (N−1)th frame, a Nth frame, and a (N+1)th frame represent the sequential frames and are displayed in a (N−1)th frame period, a Nth frame period, and a (N+1)th frame period, respectively. The image signal S comprises first image data, second image data, and third image data respectively corresponding to the (N−1)th frame, the Nth frame, and the (N+1)th frame. The first image data comprises a pixel value of a target pixel unit in the (N−1)th frame period, the second image data comprises a pixel value of the target pixel unit in the Nth frame period, and the third image data comprises a pixel value of the target pixel unit in the (N+1)th frame period. According to the embodiment, the pixel values represent gray levels displayed by the pixel units.

An image detection device 32 detects the size of the displayed object and the moving speed of the displayed object in the sequential frame periods according to the image signal and outputs an over-driving control signal Sctrl according to the detected size and moving speed. In an embodiment, the over-driving control signal Sctrl is used to determine which over-driving mechanism is arranged to drive the pixel units. For example, according to the size of the displayed object, the moving speed of the displayed object, or the width of the displayed object with the gray level lower than a predetermined gray level, a plurality of lookup tables recording different over-driving parameters are selected to generate an over-driving control signal for the pixel units. In an embodiment, the image detection device 32 comprises a pixel-value detection device 321 and an image-width determination device 323. The pixel-value detection device 321 obtains pixel values of a plurality of target pixel units in the respective frame periods according to the image signal S. The image-width determination device 323 obtains the size of the displayed object and the moving speed of the displayed object in the frame periods according to the pixel values of the target pixel units in the frame periods to generate the over-driving control signal Sctrl. In an embodiment, the over-driving control signal Sctrl is generated according to the ratio of the size and the moving speed of the displayed object. In another embodiment, a counting register (not shown in FIG. 3) is used to calculate the amount of frames with predetermined image characteristics. For example, the amount of sequential frames with the pixel values lower than a predetermined pixel value. The over-driving control signal Sctrl is generated by detecting and recording the amount of sequential frames with pixel values lower than the predetermined pixel value according to the image signal S by the image detection device 32.

Figure 4:
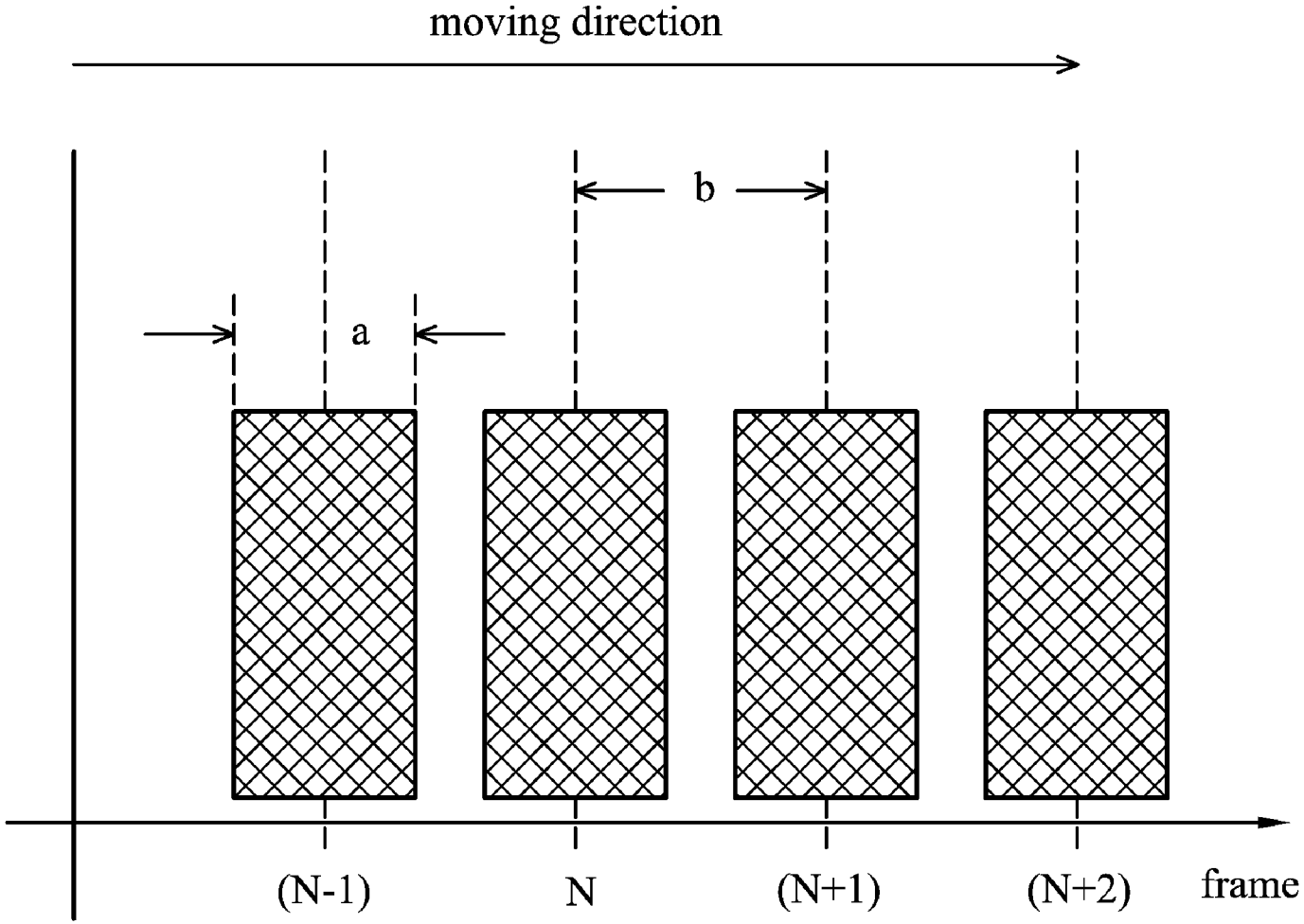
FIG. 4 shows positions of a displayed object in the (N−1)th to (N+2)th frame periods in an exemplary embodiment of the invention.

FIG. 4 shows the positions of the displayed object in the (N−1)th to (N+2)th frame periods. As shown in FIG. 4, the width of the displayed object has a pixels, and the distance between the positions of the displayed object in the two adjacent frame periods has b pixels. Since the distance between the positions of the displayed object in the two adjacent frame periods is directly proportional to the moving speed of the displayed object, the relationship between the size and the moving speed of the displayed object is obtained according to the ratio of the parameter a and the parameter b, and the corresponding over-driving control signal is generated accordingly.

Figure 3:
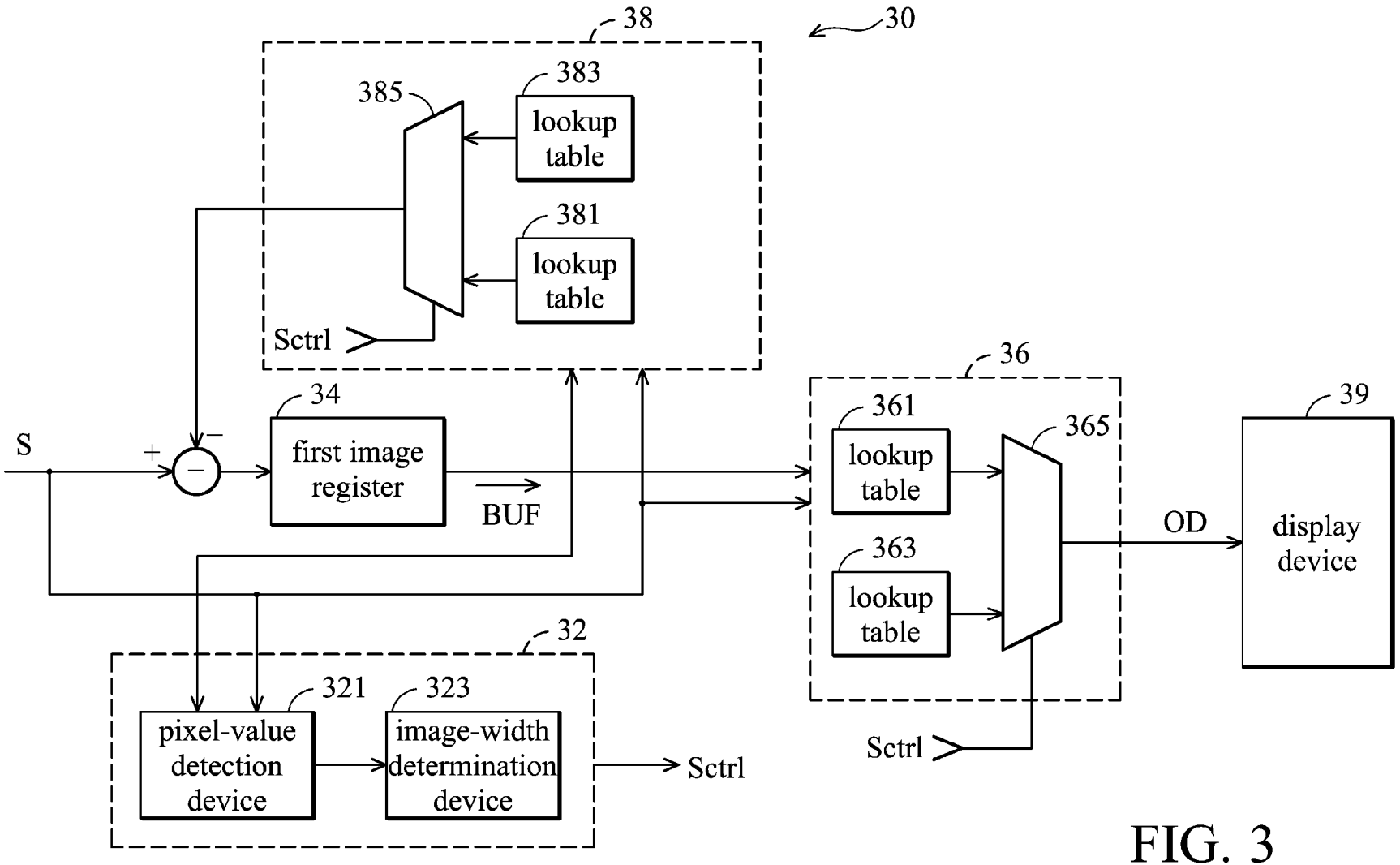
FIG. 3 shows an exemplary embodiment of an image over-driving device.

Moreover, referring to FIG. 3, the image over-driving device further comprises a first image register 34. The first image register 34 receives and temporarily stores the first image data of the image signal S in the (N−1)th frame period. The first image register 34 receives the second image data of the image signal S and outputs the first image data as a buffer data BUF in the Nth frame period sequential to the (N−1)th frame period. A first over-driving unit 36 comprises lookup tables 361 and 363 recording different over-driving parameters. The first over-driving unit 36 generates a first over-driving signal according to the buffer data BUF, the second image data, and the lookup table 361 and generates a second over-driving signal according to the buffer data BUF, the second image data, and the lookup table 363. A multiplexer 365 selects the first over-driving signal or the second over-driving signal according to the over-driving control signal Sctrl to drive the display device 39. For example, the information of the first image data of the image signal S indicates that the pixel value of the target pixel unit in the (N−1)th frame period is 230 gray-level, and the information of the second image data thereof indicates that the pixel value of the target pixel unit in the Nth frame period is 5 gray-level. After the first image data is temporarily stored by the first image register 34, the first image data is output as a buffer data BUF to the first over-driving unit 36 in the Nth frame period. At the same time, the second image data is input to the first over-driving unit 36. Thus, the first over-driving unit 36 generates the first over-driving signal according to the difference between the corresponding pixel values of the buffer data BUF (the temporarily stored first image data) and the second image data and the lookup table 361 and generates the second over-driving signal according to the difference between the corresponding pixel values of the buffer data BUF and the second image data and the lookup table 363. In another embodiment, the first over-driving unit 36 selects the corresponding lookup table according to the calculated amount of sequential frames with the pixel values lower than a predetermined pixel value by a counting register. Then, the first over-driving unit 36 generates the corresponding over-driving signal according to the difference between the corresponding pixel values of the buffer data BUF (the temporarily stored first image data) and the second image data and the selected lookup table. Since the over-driving parameters recorded in the lookup tables 361 and 363 are different, the driving abilities of the first over-driving signal and the second over-driving signal are also different.

Moreover, the image over-driving device further comprises a second over-driving unit 38 having lookup tables 381 and 383 recording different over-driving parameters. The second over-driving unit 38 generates a third over-driving signal according to the buffer data BUF, the second image data, and the lookup table 381 and generates a fourth over-driving signal according to the buffer data BUF, the second image data, and the lookup table 383. The multiplexer 385 selects the third over-driving signal or the fourth over-driving signal according to the over-driving control signal Sctrl and sends the selected over-driving signal to the first image register 34. The first image register 34 outputs the third over-driving signal or the fourth over-driving signal as the buffer data BUF in the next frame period. The above example is presented for description only. After the first image data is temporarily stored by the first image register 34 for one frame period, the first image data is output as a buffer data BUF to the second over-driving unit 38 in the Nth frame period. At the same time, the second image data is input to the second over-driving unit 38. Thus, the second over-driving unit 38 generates the third over-driving signal according to the difference between the corresponding pixel values of the first image data and the second image data and the lookup table 381 and further generates the fourth over-driving signal according to the difference between the corresponding pixel values of the first image data and the second image data and the lookup table 383. The multiplexer 385 selects the third over-driving signal or the fourth over-driving signal according to the over-driving control signal Sctrl to output the selected over-driving signal to the first image register 34. In the (N+1)th frame period, the first image register 34 outputs the temporarily stored third or fourth image data to the first over-driving unit 36. The first over-driving unit 36 generates a fifth over-driving signal according to the third or fourth over-driving signal serving as the buffer data BUF, the third image data, and the over-driving control signal Sctrl. The multiplexer 365 selects the fifth over-driving signal to output to the display device 39. The display device 39 drives the corresponding pixel unit according to the over-driving signal output (labeled by "OD") from the multiplexer 365. The over-driving control signal Sctrl can be generated according to the ratio of the size and the moving speed of the displayed object or the amount of sequential frames with the pixel values lower than a predetermined pixel value.

According to the embodiment, the over-driving control signal Sctrl can be generated according to the ratio of the size and the moving speed of the displayed object. When the ratio of the size and the moving speed of the displayed object becomes less, the overshot effect is more serious. Thus, the over-driving control signal Sctrl indicates that a lower over-driving voltage is used to adjust the cross voltage applied in the pixel unit of the display device for mitigating the overshot effect. For example, the lookup tables 361 and 381 record the over-driving parameters which are the results from the conventional over-driving method, while the lookup tables 363 and 383 record the modified over-driving parameters, that is the low over-driving voltage generated in response to the overshot effect. Thus, when the over-driving unit 36 or 38 receives the image data of two adjacent frames, if the ratio of the size and the moving speed of the displayed object is greater than a predetermined value, the over-driving control signal Sctrl indicates that the over-driving voltage is generated according to the difference between the pixel values of the image data of the two adjacent frames by using the lookup tables 361 and 381, wherein the generated over-driving voltage is equal to the conventional over-driving method over-driving voltage result. In contrast, if the ratio of the size and the moving speed of the displayed object is less than the predetermined value, the over-driving control signal Sctrl indicates that over-driving voltage is generated according to the difference between pixel values of the image data of the two adjacent frames by using the lookup tables 363 and 383, wherein the generated over-driving voltage is lower than the conventional over-driving method over-driving voltage result. Note that, in FIG. 3, each of the over-driving units 36 and 38 comprises only two lookup tables, however, the amount of lookup tables in each of the over-driving units 36 and 38 can be more than two according to realistic requirements. Hereinafter, four lookup tables in each over-driving unit are given as an example. According to the width a of the displayed object and the distance b between the positions of the displayed object in the two adjacent frame periods, the different lookup tables can be respectively selected to generate the over-driving voltage. For example, when $2b>a\geqq b$, the first lookup table is selected, when $3b>a\geqq 2b$, the second lookup table is selected, when $4b>a\geqq 3b$, the third lookup table is selected, and when $5b>a\geqq 4b$, the fourth lookup table is selected. If there are k lookup tables, the kth is selected when $(k+1)b>a\geqq k\times b$. The values of the over-driving voltage corresponding to the same pixel value difference are gradually greater from the first, second, third, to fourth lookup tables, and the over-driving voltage of the fourth lookup table is most closest to the conventional over-driving method over-driving voltage result. Thus, when the ratio of the size and the moving speed of the displayed object is less, the lower over-driving voltage is required, thereby degrading the overshot effect.

Figure 5:
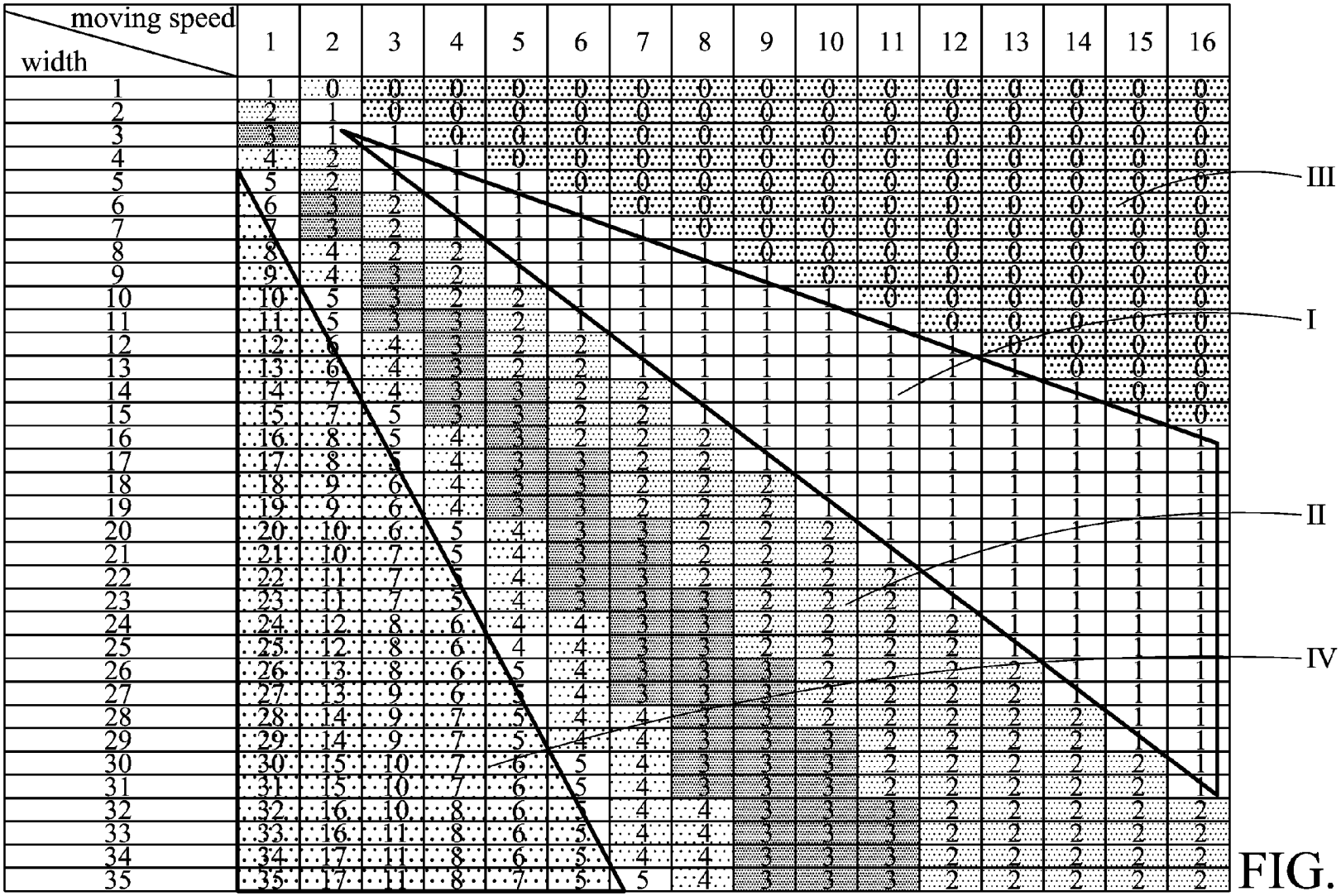
FIG. 5 shows relationship between the width and the moving speed of a displayed object in an exemplary embodiment of the invention.

FIG. 5 shows the relationship between the width and the moving speed of the displayed object according to an embodiment of the invention. As shown in FIG. 5, numbers in areas I and II represent the selected lookup tables. For example, the number "1" represent the first lookup table, the number "2" represent the second lookup table, the number "3" represent the third lookup table, and the number "4" represent the fourth lookup table. Regarding the pixel units in the area III, since the moving speed of the displayed object is fast, the human eye can not distinguish the overshot effect. Thus, the over-driving voltage is generated by the conventional over-driving method for the pixel units in the area III. Regarding the pixel units in the area IV, since the width of the displayed object is very wide, the overshot effect is not obvious. Thus, the over-driving voltage is also generated by the conventional over-driving method for the pixel units in the area IV.

Figure 6:
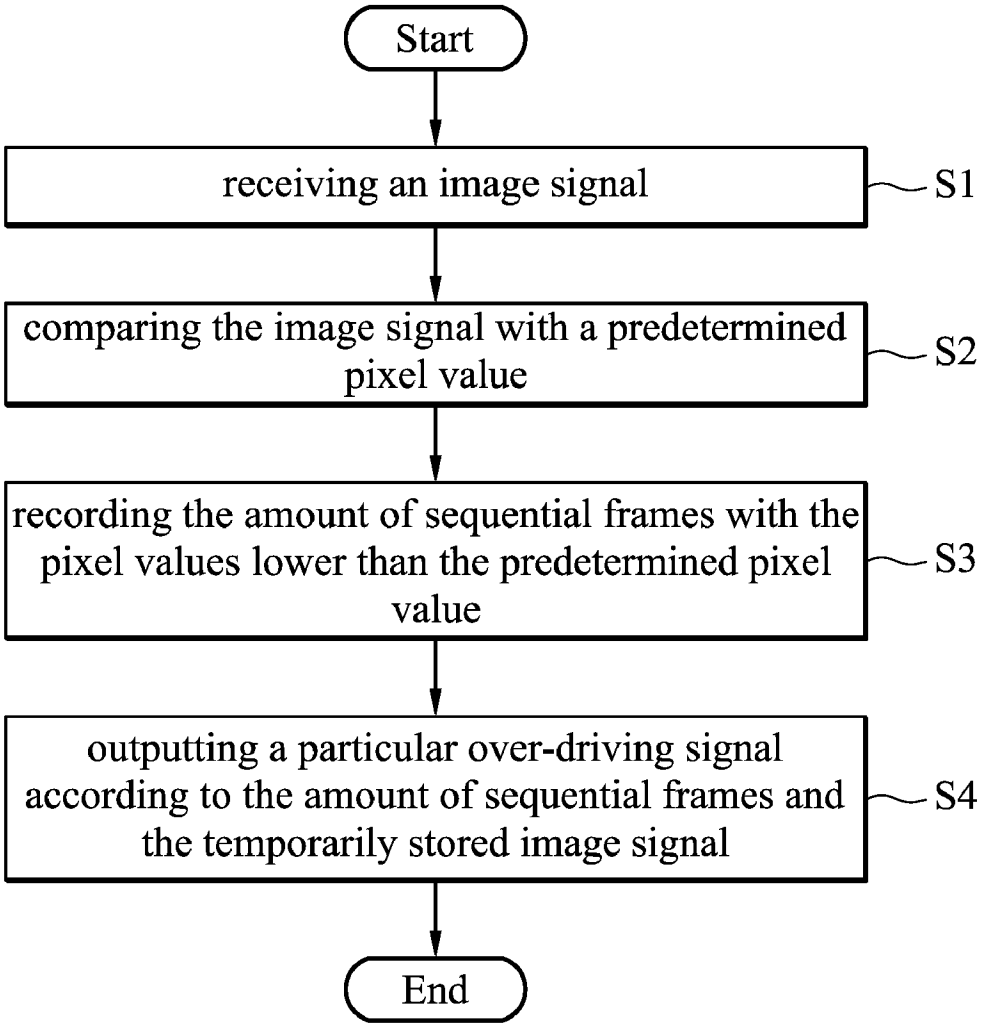
FIG. 6 is a flow chart of an image over-driving controlling method.

According to an embodiment, an image detection device is used to detect and record the amount of sequential frames with the pixel values lower than a predetermined pixel value, and the over-driving control signal Sctrl is generated according to the detected amount of sequential frames. FIG. 6 is a flow chart of an image over-driving controlling method. First, an image signal is received (step S1), wherein the image signal comprises image information of a display device in sequential frames, and the image signal can be temporarily stored in an image register. Then, the image signal is compared with a predetermined pixel value (step S2). The amount of sequential frames with the pixel values lower than the predetermined pixel value is recorded (step S3). For example, when the pixel value of the image signal in the first frame period is less than the predetermined pixel value, the pixel value of the image signal in the second frame period sequential to the first frame period is compared with the predetermined pixel value. By repeating the comparison operation, the amount of sequential frames with the pixel values lower than the predetermined pixel value is obtained. When the pixel value of the image signal in the current frame period is less than the predetermined pixel value and the pixel value of the image signal in the sequential frame period is greater than the predetermined pixel value, the image signal in the current frame period and the temporarily stored amount of sequential frames are output, and an amount of sequential frames is re-calculated. Then, according to the amount of sequential frames and the temporarily stored image signal, a particular over-driving signal is output (step S4), and a corresponding pixel unit is driven by the particular over-driving signal. In an embodiment, when the amount of sequential frames with the pixel values lower than the predetermined pixel value is less than or equal to a target number, the particular over-driving signal is generated according to the amount of sequential frames and the temporarily stored image signal. The different amounts of sequential frames correspond to different lookup tables respectively. Hereinafter, it is assumed that there are five lookup tables, and the target number is equal to 4. When the amount of sequential frames is equal to 1, the first lookup table is selected by the particular over-driving signal to generate the over-driving voltage. Additionally, when the amount of sequential frames is equal to 2, the second lookup table is selected by the particular over-driving signal, when the amount of sequential frames is equal to 3, the third lookup table is selected by the particular over-driving signal, and when the amount of sequential frames is equal to 42, the fourth lookup table is selected by the particular over-driving signal. When the amount of sequential frames is equal to and greater than 5, an over-driving signal is output and the fifth lookup table is selected to generate an over-driving voltage. Herein, the over-driving voltage generated by the fifth lookup table is the over-driving voltage generated by the conventional over-driving method. The over-driving voltage corresponding to the same pixel value difference is gradually greater from the first, second, third, to fourth lookup tables, and the over-driving voltage of the fourth lookup table is most closest to the over-driving voltage of the fifth lookup table. In the embodiment, since the target number is equal to 4, the image registers can be 2-bit image memories.

As described above, according to the image over-driving device and the image over-driving controlling method, the size and moving speed of the displayed object can be dynamically detected without change in the original mathematical calculation processes of the over-driving voltage, and the corresponding over-driving voltage is provided according to the detected resolution, thereby improving image quality.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An image over-driving device for a display device comprising a plurality of pixel units and displaying a displayed object according to an image signal in a plurality of sequential frame periods, comprising:

an image detection device for detecting a size of the displayed object and a moving speed of the displayed object in the sequential frame periods according to the image signal and outputting an over-driving control signal according to the size of the displayed object and the moving speed of the displayed object in the sequential frame periods;

a first image register for receiving and temporarily storing first image data of the image signal in a first frame period, and receiving second image data of the image signal and outputting the first image data as a buffer data in a second frame period sequential to the first frame period;

a first over-driving unit, comprising a first lookup table and a second lookup table in which the different over-driving parameters are recorded, for generating a first over-driving signal according to the buffer data, the second image data, and the first lookup table, and generating a second over-driving signal according to the buffer data, the second image data, and the second lookup table;

a first multiplexer for selecting the first over-driving signal or the second over-driving signal according to the over-driving control signal to drive the display device;

a second over-driving unit, having a third lookup table and a fourth lookup table in which the different over-driving parameters are recorded, for generating a third over-driving signal according to the buffer data, the second image data, and the third lookup table, generating a fourth over-driving signal according to the buffer data, the second image data, and the fourth lookup table; and a second multiplexer for selecting the third over-driving signal or the fourth over-driving signal according to the over-driving control signal to the first image register;

wherein the first image register outputs one of the third over-driving signal and the fourth over-driving signal as the buffer data in a third frame period sequential to the second frame period.

2. The image over-driving device as claimed in claim 1, wherein the first image data comprises a pixel value of a target pixel unit among the pixel units in the first frame period, and the second image data comprises a pixel value of the target pixel unit in the second frame period.

3. The image over-driving device as claimed in claim 1, wherein, in the second frame period, the first over-driving unit receives and compares the buffer data with the second image data, generates the first over-driving signal according to the comparison result and the first lookup table, and generates the second over-driving signal according to the comparison result and the second lookup table.

4. The image over-driving device as claimed in claim 1, wherein the image detection device comprises:

a pixel-value detection device obtaining pixel values of a target pixel unit among the pixel units in the frame periods according to the image signal; and an image-width determination device obtaining the size and the moving speed of the displayed object according to the pixel values of the target pixel unit in the frame periods to generate the over-driving control signal.

5. The image over-driving device as claimed in claim 1, wherein the over-driving control signal is generated according to a ratio of the size and the moving speed of the displayed object.

6. The image over-driving device as claimed in claim 1, wherein the first over-driving unit receives a third image data of the image signal in the third frame period, generates a fifth over-driving signal according to the buffer data, the third image data, and the over-driving control signal, and drives the display device according to the fifth over-driving signal.

7. The image over-driving device as claimed in claim 1, wherein pixel values corresponding to the displayed object are lower than a predetermined pixel value.

8. The image over-driving device as claimed in claim 1, wherein the image detection device further detects and records an amount of sequential frames with pixel values lower than a predetermined pixel value and generates the over-driving control signal according to the amount of sequential frames.

9. An image over-driving controlling method for a display device comprising a plurality of pixel units and displaying a displayed object according to an image signal in a plurality of sequential frame periods, comprising:

detecting a size of the displayed object and a moving speed of the displayed object in the sequential frame periods according to the image signal;

generating an over-driving control signal according to the size of the displayed object and the moving speed of the displayed object in the sequential frame periods;

in a first frame period, receiving and temporarily storing first image data of the image signal;

in a second frame period sequential to the first frame period, receiving second image data of the image signal and outputting the first image data as a buffer data;

generating a first over-driving signal according to the buffer data, the second image data, and the over-driving control signal and driving the display device according to the first over-driving signal;

generating a second over-driving signal according to the buffer data, the second image data, and the over-driving control signal;

temporarily storing the second over-driving signal and, in a third frame period sequential to the second frame period, outputting the second over-driving signal as the buffer data;

receiving a third image data of the image signal in the third frame period; and generating a third over-driving signal according to the buffer data, the third image data, and the over-driving control signal and driving the display device according to the third over-driving signal.

10. The image over-driving controlling method as claimed in claim 9, wherein the first image data comprises a pixel value of a target pixel unit among the pixel units in the first frame period, and the second image data comprises a pixel value of the target pixel unit in the second frame period.

11. The image over-driving controlling method as claimed in claim 9 further comprising:

respectively recording a plurality of over-driving parameters by a plurality of lookup tables; and selecting one of the lookup tables according to the over-driving control signal, the buffer data, and the second image data to generate the first over-driving signal.

12. The image over-driving controlling method as claimed in claim 9 further comprising:

obtaining pixel values of a target pixel unit among the pixel units in the frame periods according to the image signal; and obtaining the size and the moving speed of the displayed object according to the pixel values of the target pixel unit in the frame periods to generate the over-driving control signal.

13. The image over-driving controlling method as claimed in claim 9, wherein the over-driving control signal is generated according to a ratio of the size and the moving speed of the displayed object.

14. The image over-driving controlling method as claimed in claim 9 further comprising:

respectively recording a plurality of over-driving parameters by a plurality of lookup tables; and selecting one of the lookup tables according to the over-driving control signal, the buffer data, and the second image data to generate the second over-driving signal.

15. The image over-driving controlling method as claimed in claim 9, wherein pixel values corresponding to the displayed object are lower than a predetermined pixel value.

16. The image over-driving controlling method as claimed in claim 9 further comprising detecting and recording an amount of sequential frames with pixel values lower than a predetermined pixel value and generating the over-driving control signal according to the amount of sequential frames.

* * * * *